United States Patent [19]

Reinhardt

[11] Patent Number: 4,629,011

[45] Date of Patent: Dec. 16, 1986

[54] METHOD AND APPARATUS FOR TAKING CORE SAMPLES FROM A SUBTERRANEAN WELL SIDE WALL

[75] Inventor: Paul A. Reinhardt, Houston, Tex.

[73] Assignee: Baker Oil Tools, Inc., Orange, Calif.

[21] Appl. No.: 764,613

[22] Filed: Aug. 12, 1985

[51] Int. Cl.[4] ..... E21B 49/02

[52] U.S. Cl. ..... 175/58; 175/251; 175/284; 175/403

[58] Field of Search ..... 175/20, 58, 244, 246, 175/248, 249, 251, 281, 284, 325, 403

[56] References Cited

U.S. PATENT DOCUMENTS

| | | | |
|---|---|---|---|
| 1,730,705 | 10/1929 | Wild | 175/251 |
| 2,053,698 | 9/1936 | Church | 175/325 |
| 2,354,399 | 7/1944 | Noble | 175/248 |
| 3,330,367 | 7/1967 | Redwine | 175/58 |
| 3,630,296 | 12/1971 | Bullard | 175/58 |

*Primary Examiner*—Stephen J. Novosad
*Assistant Examiner*—Terry Lee Melius
*Attorney, Agent, or Firm*—Norvell & Associates

[57] ABSTRACT

Apparatus for extracting core samples from the side walls of a subterranean well bore comprises an axial force generating tool insertable into the well with such tool carrying a stationary support rod and the movable element of such tool producing a movement of a housing surrounding the stationary support rod. Annular core forming tools are mounted on plural anvil plates disposed on sides of the stationary support rod and such tools are moved into penetrating relationship with the well bore side wall through association with a linkage between the movable housing, the anvil plates, and the stationary support rod. The movement of the axial force generating element is opposed by a resistance element. A limit to the maximum force applied to the core forming tools is provided by a shearable element series connected in the stationary support rod. Fluid dampening is provided for the decompression movement of the resistance element subsequent to the shearing of the stationary support rod to avoid dislodgement of the entrapped core samples by impact forces.

19 Claims, 10 Drawing Figures

METHOD AND APPARATUS FOR TAKING CORE SAMPLES FROM A SUBTERRANEAN WELL SIDE WALL

BACKGROUND OF THE INVENTION

1. Field of the Invention: The invention relates to a method and apparatus for extracting core samples from any selected location in the side wall of a subterranean well.

2. History of the Prior Art: The taking of core samples during the drilling of a well is a time honored procedure. The prevailing practice has been to interrupt the drilling process, run an annular cutting tool into the bottom of the well, which tool is suspended beneath a core collecting barrel. Rotation of the annular cutting tool will effect the cutting of the core from the central portions of the well bottom which is trapped in the core barrel and removed to the surface for examination.

The difficulty with this method of obtaining core samples is that it is extremely time consuming in that you must interrupt the utilization of the rig for drilling purposes in order to take the core sample. As a result, the drilling rig operator has to be fairly certain as to where he wants core samples taken so as to minimize the number of times that the drilling operation is interrupted.

A better procedure is to drill in the entire well and then extract samples at any selected location through the utilization of side wall coring tools. These tools have heretofore taken the form of a hollow bullet which is forced radially outwardly by the discharge of an explosive propellant charge. The annular bullet embeds in the side wall of the well and has recovery cables connected to it which are then manipulated by an up and down movement of the work string to effect the loosening of the bullet from the side wall and the retrieval of the annular bullet, with the core sample contained therein, to the well surface. This method of obtaining core samples inherently results in the extraction of a very pulverized sample due to the fact that the bullet is impacted against the side wall with a large amount of kinetic energy. Obviously, the maximum energy imparted to the bullet occurs immediately after the discharge of the propellant charge. As a result both the rock grains and the sand grains are shattered, and the resulting core sample is not typical of the virgin condition of the rock. This drastically reduces the quality of the analysis that can be made from the crushed rock samples.

Another prior art approach to procuring said wall core samples was to incorporate diamond bladed saws or hollow rotary drills on the bottom of a wire line which were driven by small electric motors. Obviously, this requires the running of electric wire line which must continually carry considerable current, thus reducing the ability to be spliced and also reducing wire line life, itself. Furthermore, such prior art approaches resulted in the wire line carrying the entire tool weight, which further adversely effected wire line life and integrety. Moreover, such prior art devices also resulted in the material cutout of the sidewall being sometimes differentially stuck to the well bore and, therefore, difficult to recover. Furthermore, during the time in which it takes to drill these samples, the tool is static in the well and thus may contribute to its own differential sticking in the well, posing still another additional problem.

It follows that there is a definitive need in the well drilling art for a method and apparatus for efficiently extracting core samples from the side wall of a drilled well which will not result in the crushing of the sample, and which will readily retract the sample, once cut from the side wall, and permit it to be carried to the surface in an intact, almost virgin condition.

SUMMARY OF THE INVENTION

The method and apparatus of this invention contemplates the utilization of annular core tools which are pushed into penetrating relationship with any selected region of a subterranean well side wall by a mechanical linkage. The mechanical linkage is in turn actuated by a conventional downhole force producing mechanism, such as employed for setting packers or bridge plugs, which produces a large axially downward force which is connected to the linkage and translated into a radially outwardly directed force to drive the core tools into penetrating relationship with the selected side wall zone.

With this method and apparatus, the energy absorbed by the linkage is actually at a minimum until the coring tool moves radially outwardly into engagement with the selected side wall zone. From that point, the penetrating energy applied to the annular core tools keeps increasing so that the annular "knife edge" provided on the annular core tool readily pierces the rock and penetrates the rock without pulverizing the entire rock strata encompassed by the annular tool. There is no impact against the side wall that would have the effect of setting up fisures and fractures in the rock. As a result, a core sample is trapped in the bore of the annular core tool in a substantially virgin condition.

After a maximum axial force is developed in the downhole force producing mechanism, a shearable section of the supporting rod for the linkage on which the annual coring tools are mounted, is sheared, and this shearing action permits the retraction of the annular core tools in a radially inward direction for disengagement from the well side wall due to the action of a resistance element, such as a compressed spring, which is compressed by the initial movement of the axial force producing mechanism. In this manner, it is assured that no excessive force will be applied to the core tool actuating linkage which would result in damage to such linkage, so that the coring tool may be reused many times merely by replacing the sheared out section of the supporting rod when the tool is returned to the surface with the entrapped core samples.

In a preferred embodiment of the invention, two anvil plates are provided in parallel relationship with respect to a stationary central support rod. A parallelogram linkage interconnects the anvil plates with the stationary support rod and also with a housing surrounding the support rod. The housing is movable downwardly relative to the support rod by the downhole axial force producing mechanism. Such downward movement effects an expansion of the parallelogram linkage to concurrently move the anvil plates radially outwardly towards the adjacent side wall of the well. Each anvil plate carries one or more annular coring tools having a sharpened annular edge. Once such edge contacts the adjacent side wall of the well, the force applied through the parallelogram linkage is very substantially increased to effect a penetration of all of the annular coring tools carried by the two anvil plates into the side wall of the well bore.

The support rod incorporates a shearable section which is threadably secured at both ends in series relationship with the support rod and is thus exposed to the tension force exerted on the support rod by the downward movement of the actuating housing driven by the downhole axial force producing mechanism. Such shearable section shears at a preselected tensile value corresponding to the maximum outward force that the operator desires to exert on the annular core tools. Obviously, if only two annular core tools are employed, one on each anvil plate, then the radial force applied to such tools can be far in excess of the compressive strength of any rock encountered in subterranean well bores. Normally, the anvil plates each accommodate a plurality of annular core tools with each core tool exerting a maximum compressive strength which is more than sufficient to effect the shearing of the side wall rock and the isolation of a core sample.

During the radial outward movement of the annular core tools, an axially disposed spring is compressed by the downward movement of the actuating housing relative to the stationary support rod. This spring effects the retraction of the parallelogram linkage to its normal run-in position whenever the shearable rod section of the support rod is sheared. In order to prevent a violent retraction movement, with the potential of loss of the contained core samples in the annular core tools, a hydraulic damper is provided to resist the return movement of the spring and thus cushion the retraction movements of the annular coring tools.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1A:
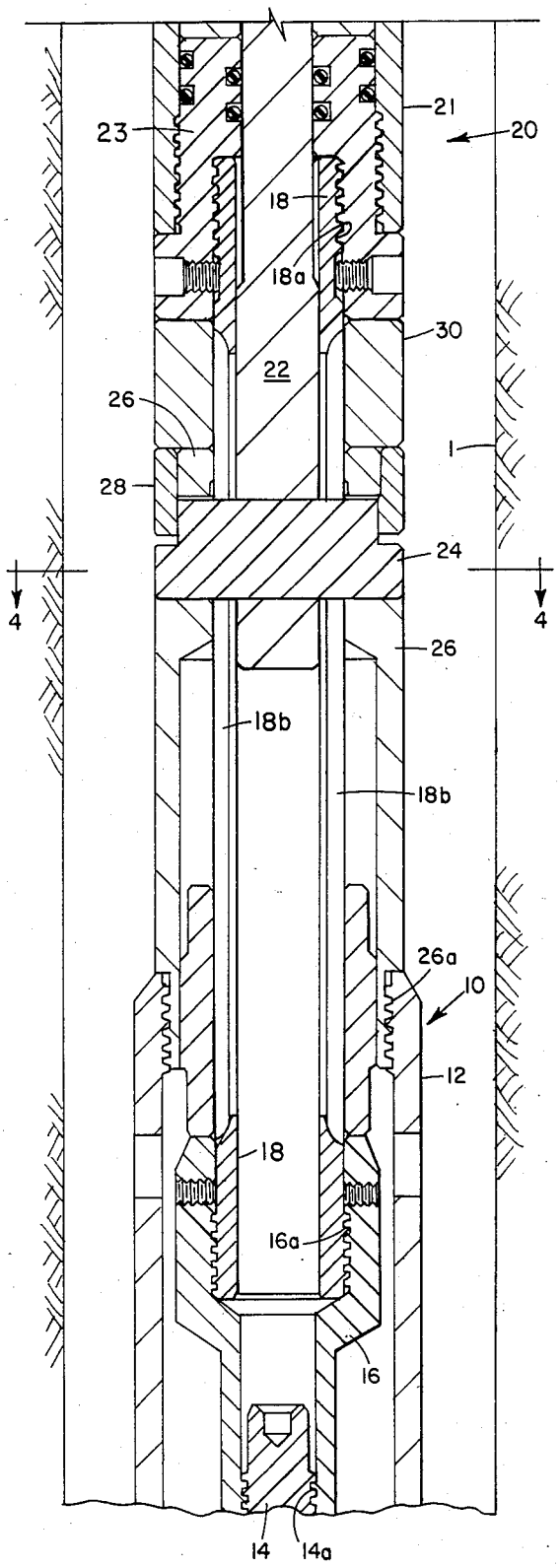
FIGS. 1A, 1B, and 1C collectively represent a vertical, sectional view of a subterranean well core sampling apparatus constructed in accordance with this invention, with the elements thereof shown in their run-in or inoperative positions.
Figure 2A:
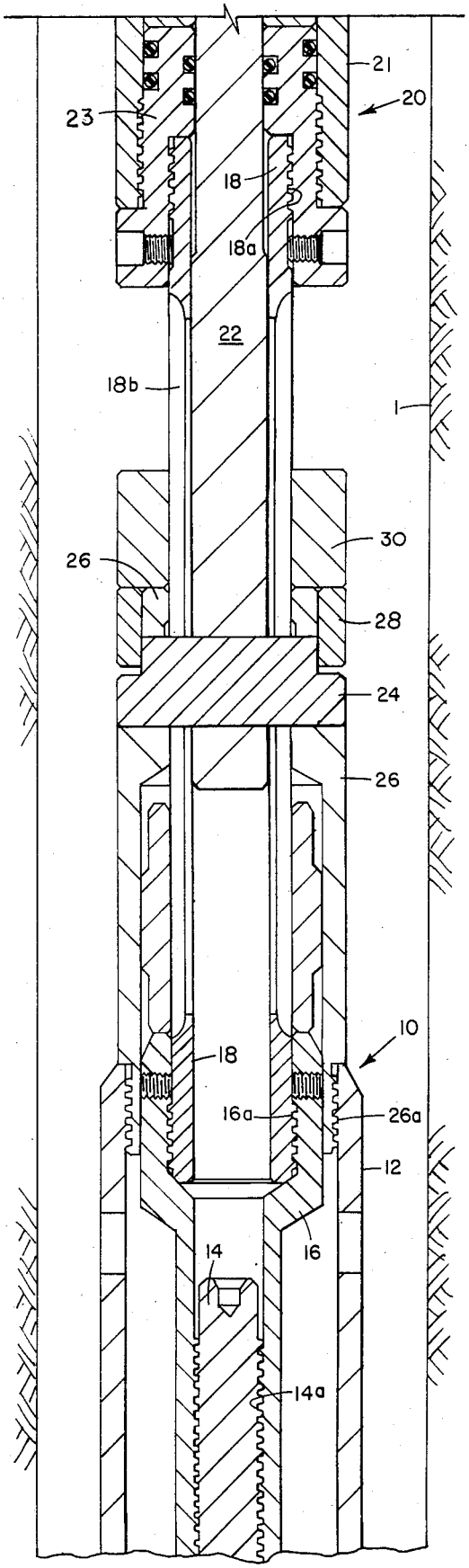
FIGS. 2A, 2B and 2C are views respectively similar to FIGS. 1A, 1B and 1C but showing the elements of the core sampling apparatus in their activated position wherein the core removal tools are embedded in the well side wall.
Figure 1B:
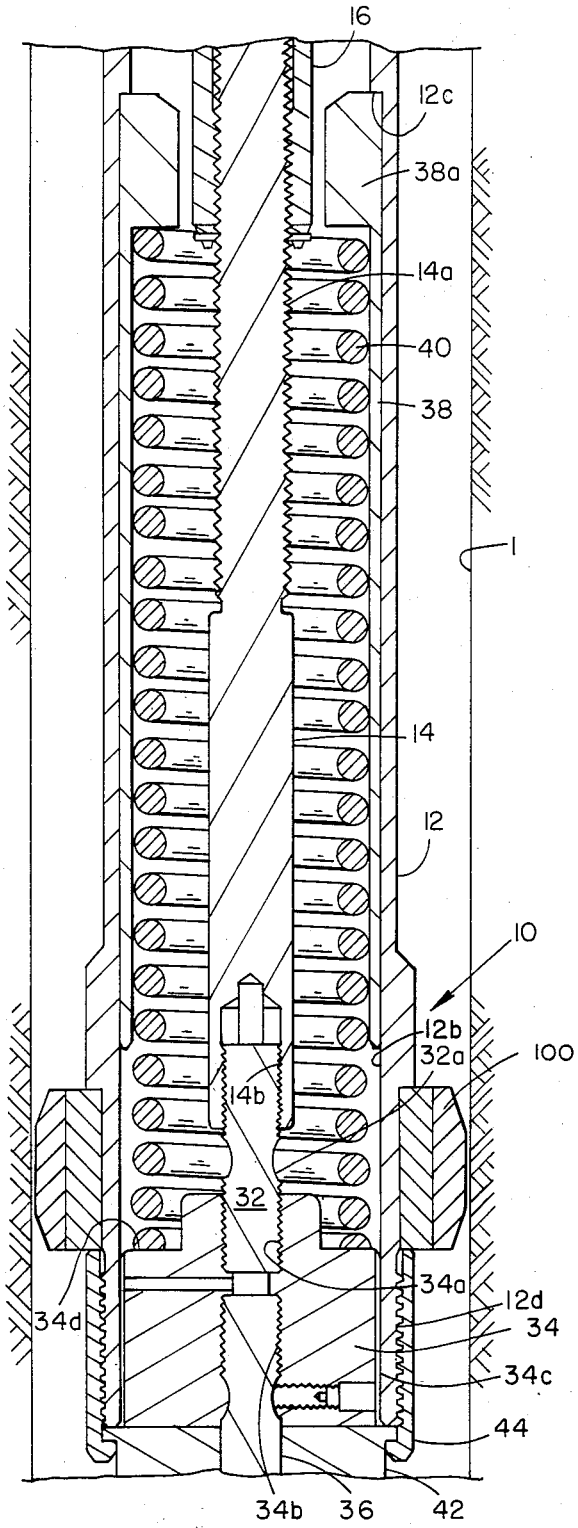
Figure 1C:
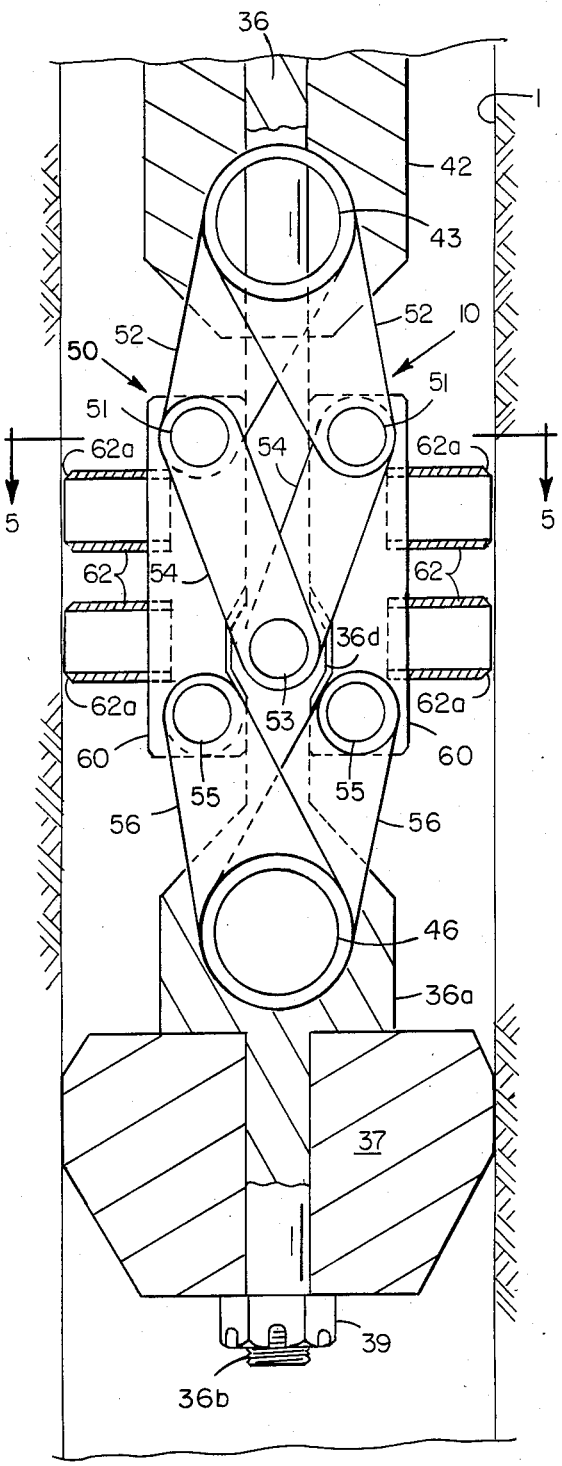
Figure 2C:
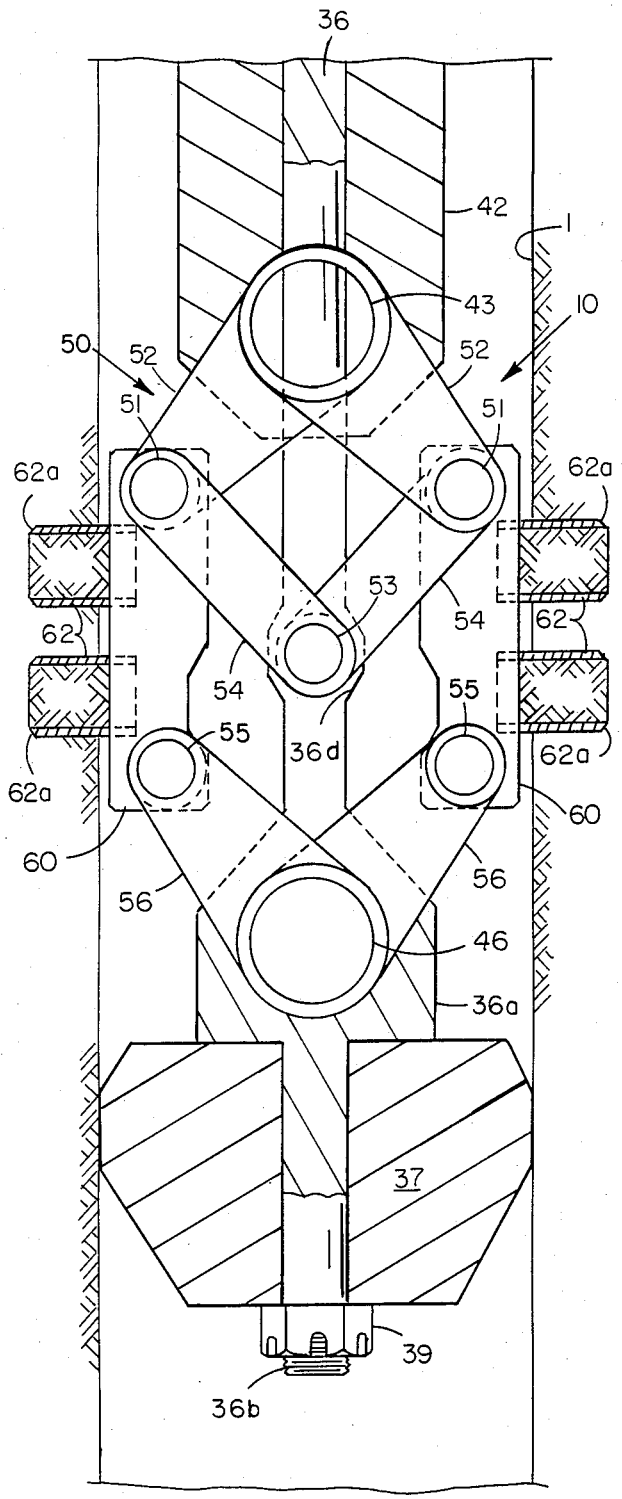

Referring to FIGS. 1A, 1B and 1C, there is shown a core sampling apparatus 10 embodying this invention suspended in a well bore 1 by an axial force generating device 20 which in turn is suspended in the well bore by a wireline (not shown). The axial force generating apparatus may comprise any one of several known forms of pressure setting apparatuses which are currently available on the market, for example, the Model E-4 Wireline Pressure Assembly made by BAKER SERVICE TOOLS Division of Baker Oil Tools, Inc., of Houston, Tex. Such apparatus includes an outer housing assembly 21 of which only the lower portion is shown, which is fixedly secured at its upper end to a wireline. Within the outer housing 21 there is provided a cooperating piston and cylinder assembly (not shown) in which a substantial gas force may be generated through the discharge of a slow burning charge, resulting in the driving of the piston downwardly and producing downward movement of a piston rod 22 which projects downwardly out of a sealing sleeve 23. Since the axial force generating apparatus 20 is an entirely conventional tool, well known in the well drilling industry, it will not be further described or illustrated other than to state upon actuation of the axial force generating tool 20, the piston rod 22 is driven downwardly from the position illustrated in FIG. 1A to the position illustrated in FIG. 2A with a substantial amount of force.

Figure 4:
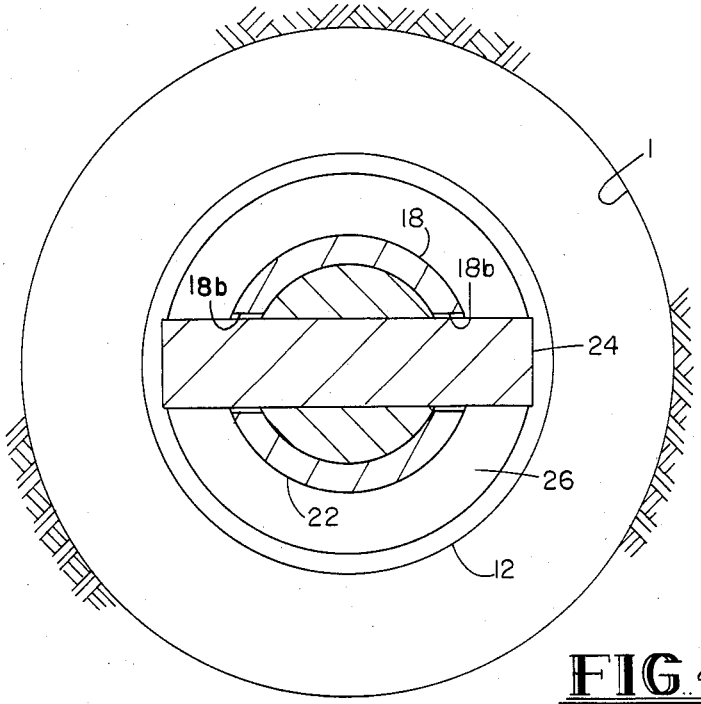
FIG. 4 is a sectional view taken on the plane 4—4 of FIG. 1A.

The core sampling tool 10 embodying this invention comprises a movable, outer housing assembly 12 which is abuttingly connected to the piston 22 in a manner to be hereinafter described, surrounding a stationary support rod 14 which is secured to the stationary housing portion of the axial force generating apparatus 20 by a sleeve assembly. The upper end of the stationary support rod 14 is provided with threads **14*a* which are threadably engaged with the internal threads provided in an enlargement sub 16. Enlargement sub 16 is provided at its upper end with a larger diameter internally threaded bore 16*a* and is secured by such threads to the lower threaded end of a space out sleeve 18 which in turn is provided at its upper end with external threads 18*a* to cooperate with the internal threads provided on the seal sleeve 23. Sleeve 18 is further provided with diametrically opposed, axially extending slots 18*b* which accommodate a transverse key 24 which is mounted in radially projecting relationship in the piston rod 22 (FIG. 4). In its inactive position, the key 24 abuts the upper end of a force transmitting sleeve 26 which is mounted in slidable, surrounding relationship to the space out sleeve 18. The lower end of the force transmitting sleeve 26 is provided with external threads 26*a* which engage internal threads provided in the upper end of the outer movable housing member 12**.

The key 24 is retained in its initial radial position illustrated in FIG. 1A by a pair of cooperating sleeves 26 and 28. These sleeves are in turn abutted by a spacer sleeve 30 which abuts the bottom end of the bearing sleeve 23. The primary reason for the spacer sleeve 30 is to reduce the active stroke of the actuating piston 22 of the axial force generating apparatus 20 by approximately fifty percent. Such limitation of stroke of the actuating piston 22 is desirable to prevent excessive acceleration of the piston during the initial portion of its travel when it is not opposed by any substantial forces. In any event, it will be clear from the foregoing description that a significant downward movement of the outer housing 12 relative to the stationary support rod 14 occurs whenever the axial force generating apparatus 20 is activated.

Referring now primarily to FIG. 1B, the lower end of the stationary support rod 14 is provided with an internally threaded bore **14*b*. A shearable plug 32 having a reduced diameter central section 32*a* is engaged with threads 14*b* at its upper end and at its lower end engages threads 34*a* provided in the upper end of a piston head 34. Piston head 34 is additionally provided with internal threads 34*b* for receiving the upper threaded end of a support rod extension 36**. The outer cylindrical periphery 34c of the piston head 34 is disposed in close proximity to the internal bore wall 12b of the outer sleeve 12 for a purpose to be hereinafter described. A spring seating sleeve 38 is provided which is inserted within the bore 12b of the outer housing 12 and abuts against a downwardly facing shoulder 12c provided in sleeve housing 12. A compression spring 40 is then mounted between an internally projecting shoulder 38a provided on the spring seating sleeve 38 and the upwardly facing surface 34d provided on the piston head 34. Thus, downward movement of the outer sleeve housing 12 relative to the stationary support rod 14 will produce a compression of spring 40. The annular chamber containing spring 40 is not sealed from above with respect to well fluids and hence is filled with well fluid.

Figure 2B:
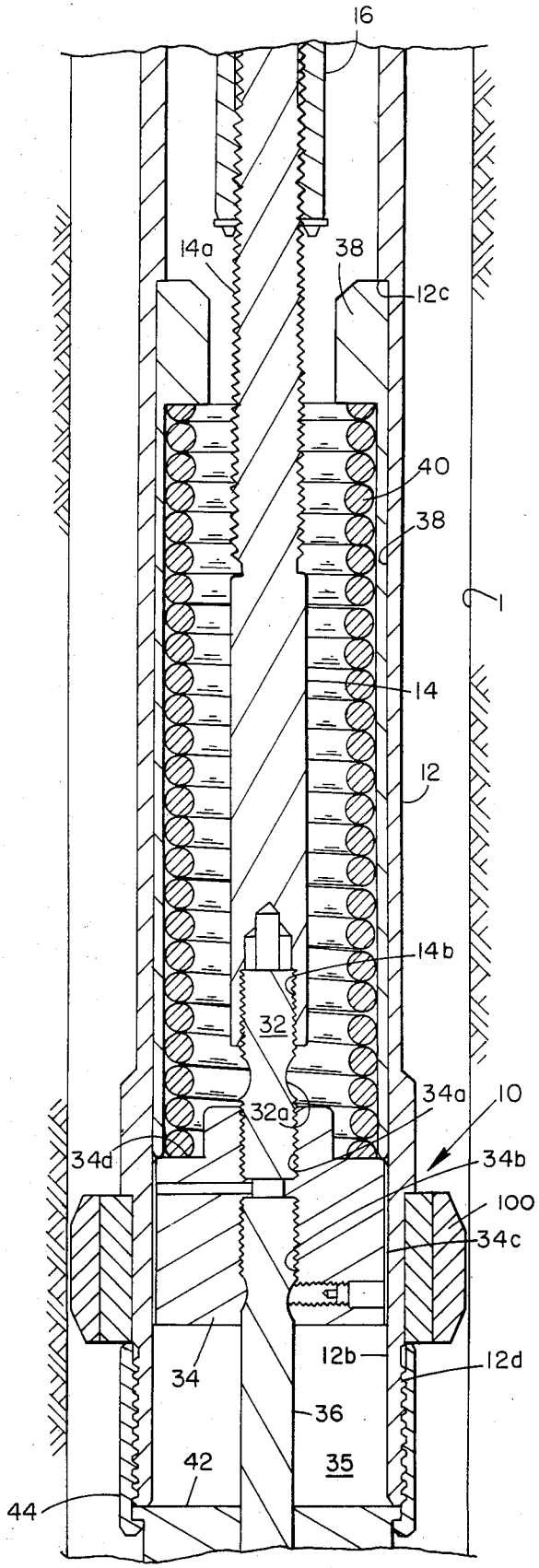

An annular linkage support block 42 is secured in depending relationship to an anchor sleeve 44 which is threadably secured by threads 12d to the bottom end of the outer movable sleeve housing 12. Thus, as the movable sleeve housing 12 is moved downwardly by the actuating piston 22, a chamber 35 (FIG. 2B) is developed between the bottom end of the piston head 34 and the top end of the annular pivot block 42. Well fluids can leak into this chamber through the clearance provided around the periphery of 34c of the piston head 34. When the motion of the sleeve 12 relative to the support rod 14 is reversed, the fluid contained in the chamber 35 then acts as dampening fluid, since it can only escape by passage through the relatively constricted annular orifice defined between the piston head 34 and the inner bore 12b of the movable outer housing 12.

In instances in which the apparatus of the present invention is utilized in "air holes", i.e., well conditions in which fluids therein are contained in the well in a nominal presence such that a hydrostatic head is not formed, and there is generally no fluid in such wells, or alternatively, very little fluid in such wells, the chamber area provided by elements 42 and 36, thus providing chamber 35, must be filled with fluid prior to the apparatus being inserted into the well bore in order to provide the dampening fluid means, thus substituting for the well fluids, which function in the same manner, as described in the previous paragraph.

A guide ring 100 may be secured on the lower portions of housing 12 by anchor sleeve 44.

Referring now to FIG. 1C, the lower end of the annular pivot block 42 mounts a transverse pivot pin 43 which provides the force applicating connection to a parallelogram linkage 50. The stationary support rod extension 36 extends downwardly through a suitable aperture (not shown) provided in the pivot pin 43 and terminates in an enlarged shoulder portion 36a against which is mounted an annular guide member 37. Guide member 37 is secured in place by a nut 39 secured to external threads 36b provided on the bottom end of the stationary support rod extension 36. The enlarged portion 36a of support rod extension 36 defines a mounting for a transverse pivot pin 46 which provides mounting for the opposite end of the parallelogram linkage 50.

Figure 5:
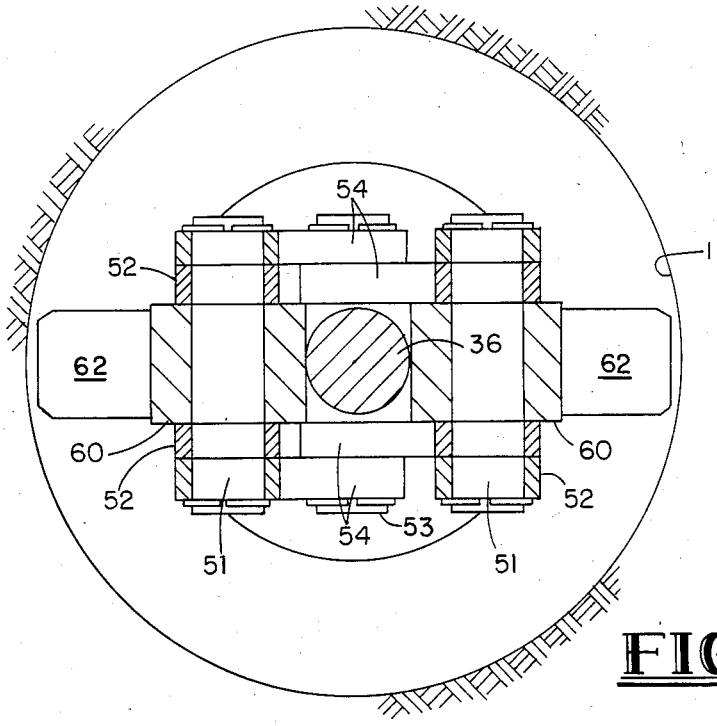
FIG. 5 is a sectional view taken on the plane 5—5 of FIG. 1C.

A pair of anvil plates 60 are disposed on opposite sides of the support rod extension 36 intermediate the pivot pins 43 and 46. Each anvil 60 mounts at least one annular core forming tool 62 in radially disposed relationship by insertion of the tool in a suitable aperture in the outer wall of each anvil. In the specific example illustrated in the drawings, two of such annular core forming tools 62 are mounted in each anvil 60. A first set of links 52 effect the pivotal connection of the upper end of anvils 60 to the pivot pin 43. As best shown in FIG. 5, the links 52 are in duplicate on each side of the support rod extension 36. Pivot pins 51 effect the securement of links 52 to anvils 60. A second set of links 54 are pivotally mounted on pivot pins 51 and are joined at their lower ends to a pivot pin 53 which traverses a radially enlarged section 36d of the stationary support rod extension 36. Lastly, a third set of links 56 are pivotally mounted at their upper ends on pivot pins 55 traversing the anvil plates 60 and are secured to the lower pivot pin 46 provided in the enlarged section 36a of the support rod extension 36.

It will be noted that one pair of links 52 is parallel to one pair of links 54 and also parallel to one pair of links 56, while the other pairs of links 52, 54 and 56 are respectively parallel to each other. It is therefore apparent that whenever the force transmitting housing 12 is moved downwardly through the actuation of the axial force generating apparatus 20, the parallelogram linkage 50 will result in a radial displacement of the anvil plates 60, thus driving the annular core forming tools 62 radially into penetrating engagement with the wall of the well bore 1. The annular core forming tools 62 are of conventional configuration, having annular edges 62a at their outer extremities to facilitate their penetration into the well bore side wall.

It is desirable to limit the penetration of the tools 62 into the well bore side walls so as to insure that the tools may be readily retracted without damage to the entrapped core samples. This limiting movement is provided by the distance between the bottom end of the spring support sleeve 38 and the upwardly facing spring supporting surface 34d provided on the piston head 34.

Figure 3B:
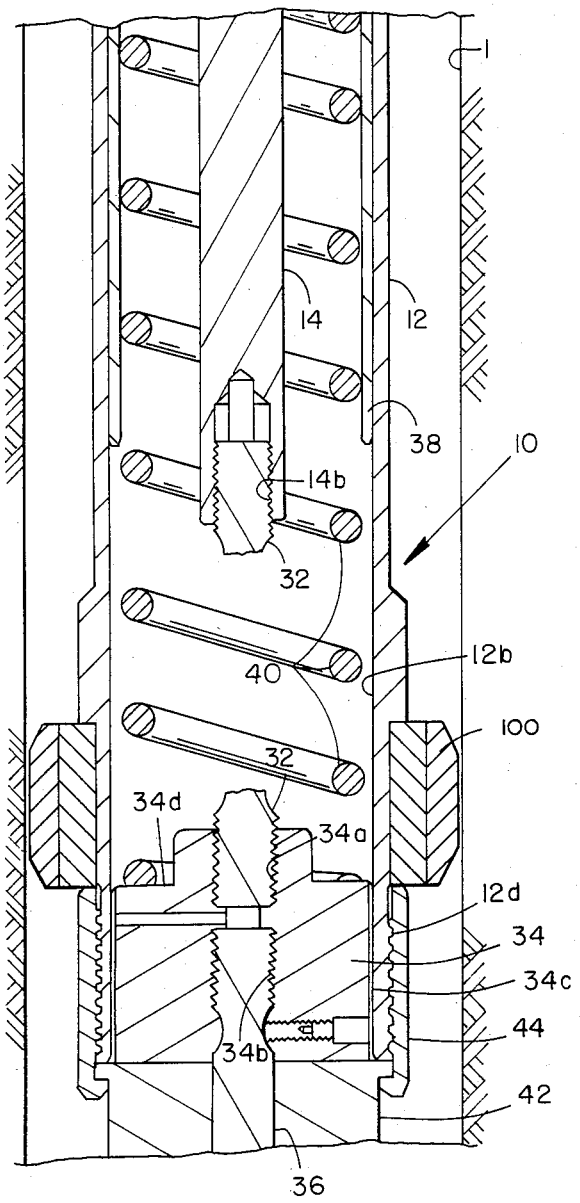
FIGS. 3B and 3C are views respectively corresponding to FIGS. 2B and 2C but showing the position of the elements after maximum force has been exerted on the core removal apparatus.
Figure 3C:
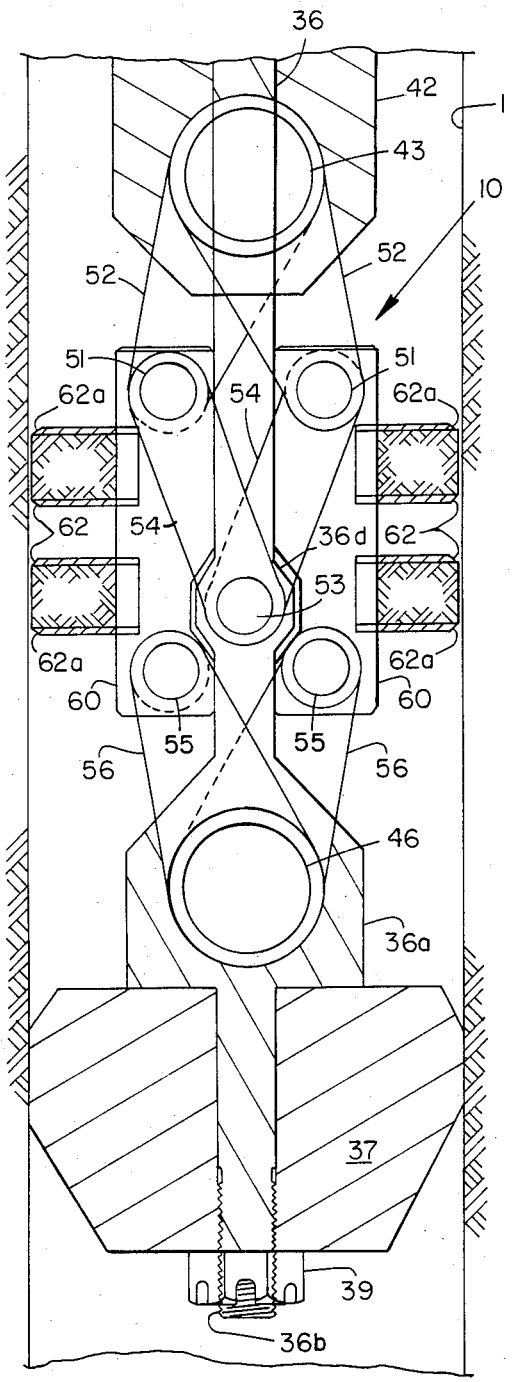

In operation, the axial force generating tool 20 is actuated to drive the piston 22 downwardly, thus forcing the outer sleeve housing 12 downwardly with respect to the stationary support rod assembly 14. Such downward movement effects a radial expansion of the anvil plates 60 due to the translation of the axial motion to radial motion provided by the parallelogram linkage 50. At the same time, a substantial amplification of the downward force is produced. Of course, very little force is required by the apparatus until the annular core forming tools 62 contact the well bore side wall. At this point, the radial force applied to each of the annular core forming tools becomes increasingly large, and more than that which is necessary to effect the penetration of the annular core forming tools by compressive shearing of the side wall rock. To prevent excessive forces being applied to the annular core forming tools, the reduced diameter shearable section 32a of the shearable plug 32, which is connected in series relationship in the support rod structure, provides a limit by shearing at a preselected level determined by the diameter of the reduced shearable section 32a. Upon such shearing, the compressed spring 40 drives the lower extension portion 36 of the support rod downwardly to the position illustrated in FIG. 3C, thus effecting the radial retraction of the annular core forming tools 62 with the core samples entrapped therein. As a practical matter, the initial release by the shearing of the stationary support rod produces a radial force inward combined with a translational force downward which effects the cracking and severing of the core samples contained therein from the adjoining wall, and breaking away of rock material outside the core forming tool to lessen the chance of differential sticking. The guides around the exterior of the tool act to protect the core forming tools going in and out of the well and serve as lever points for retraction, should only one anvil and its core forming tools become free upon release of the retraction mechanism.

After such retraction movement of the annular core forming tools, the entire apparatus may be removed from the well by wireline and is completely reusable upon replacement of the explosive charge contained in the axial force generating apparatus 20 and replacement of the shearable plug 32.

The core samples produced by the aforedescribed apparatus have been found to be uniquely suited for high quality analysis due to the fact that little, if any, shearing of the entrapped core sample is encountered and certainly crushing of the rock and/or sand contained in the core sample is completely eliminated. The fluid dampening of the retraction movement of the annular core forming tools produced by dampening the decompression movements of the spring 40 provides assurance that the entrapped core samples will not be dislodged by a sudden stoppage to the downward movement of the core sampling apparatus when the spring 40 reaches its fully extended position illustrated in FIG. 3*b* and 3*c*.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for extracting core samples from the side wall of a subterranean well, comprising: an axial force generating apparatus including a hollow housing suspendable in the well in a fixed location; a force transmitting element projecting from said housing; means in said housing for generating an axially forced displacement of said force transmitting element; a stationary support structure depending from said hollow housing; an annular core forming element mounted immediate said support structure for radial movements relative to the well, the axis of said annular core forming element being radially disposed with respect to the axis of the well, and force translating means for transmitting a radial force to said annular core forming element by activation of said force transmitting element sufficient to penetrate the well side wall to isolate a cylindrical core sample in said annular core forming element.

2. The apparatus of claim 1 further comprising resilient means opposing said activation of said force transmitting element to retract said annular core forming element from its side wall engaging position.

3. The apparatus of claim 2 further comprising fluid dampening means opposing the decompression movement of said resilient means, thereby cushioning the retraction movement of said annular core forming element.

4. The apparatus of claim 1 wherein a second annular core forming element is mounted in diametrically opposed relation to said first mentioned annular core forming element for radial movement, and said force translating means moves both said core forming elements concurrently radially into engagement with the well side wall.

5. The apparatus of claim 4 wherein said force translating means comprises a parallelogram linkage operatively interconnecting both said annular core forming elements, said force transmitting element and said stationary support structure.

6. Apparatus for extracting core samples from the side wall of a subterranean well, comprising, in combination: a support rod stationarily axially mounted in the well; a pair of anvil plates disposed on opposite sides of said stationary support rod and parallel thereto; linkage means connecting said anvil plates to said support rod for concurrent movement in a radially outward direction to approach opposed side wall portions of the well, said linkage means being responsive to an axial force to produce said radially outward movement of said anvil plates; at least one annular core forming element secured to each anvil plate in radially projecting relationship and with the axis of each annular core forming element being horizontally disposed relative to the well axis, thereby concurrently contacting said opposed well side wall portions; and actuator means for applying an axial force to said linkage means of sufficient magneitude to cause each said annualr core forming element to embed in said well side wall portions to form a cylindrical core sample.

7. The apparatus of claim 6 wherein said linkage means comprises a parallelogram linkage operatively interconnecting both said anvil plates, said support rod and said actuator means.

8. The apparatus of claim 6 wherein said actuator means comprises a downhole pressure setting assembly.

9. The apparatus of claim 6 further comprising resilient means opposite movement of said actuator means, thereby radially retracting said annular core forming members upon cessation of said axial force on said linkage means.

10. The apparatus of claim 9 wherein said support rod is subjected to a tensile stress by the application of axial force to said linkage means; said support rod including a reduced diameter section proportioned to shear whenever a preselected axial force is applied to said linkage means, thereby limiting the radial force applied to said annular core forming elements.

11. The apparatus of claim 10 further comprising resilient means opposing said axial force transmitting means, thereby radially retracting said annular core forming members upon shearing of said support rod.

12. The apparatus of claim 11 further comprising fluid dampening means opposing the decompression movement of said resilient means, thereby cushioning the radial retraction movement of said annular core forming element.

13. The apparatus of claim 9 wherein said means for applying an axial force to said linkage means comprises cooperating piston and cylinder elements coaxially disposed in the well bore; pressure means for forcing one of said elements downwardly; means securing said support rod to the other said element, and means for pivotally interconnecting said linkage means and said one element.

14. The apparatus of claim 13 wherein said one element includes a downwardly movable piston rod and said other element includes a stationary cylindrical housing surrounding said piston rod; a first sleeve assembly connecting the top of said support rod to said cylindrical housing; said first sleeve assembly having an axial slot adjacent said piston rod; a second sleeve assembly surrounding said support rod and connected to said linkage means; and a force transmitting key mounted in said piston rod in laterally projecting relation to extend through said slot and engage said second sleeve assemblage to transmit a downward force thereto.

15. The apparatus of claim 10 further comprising resilient means opposing said axial force transmitting means, thereby producing a radial force inward together with a translational force downward to thereby effect severing of said core samples from the said sidewall of the well and the breaking away of rock-like material exterior of the apparatus to thereby reduce likelihood of differential sticking.

16. The apparatus of claim 11 wherein said actuator means includes a downwardly movable sleeve surrounding said stationary support rod; a piston head secured to said stationary support rod and cooperating with said downwardly movable sleeve to define a constricted annular fluid dampening passage connecting with a fluid chamber in said sleeve, whereby downward movement of said sleeve relative to said stationary support rod fills said fluid chamber with fluid which is expelled through said annular fluid dampening passage by said resilient means after shearing said stationary support rod, thereby cushioning the radial retraction movement of said annular core elements from the well side wall.

17. The method of extracting core samples from any selected portion of the side wall of a subterranean well, comprising the steps of:

(1) mounting a plurality of annular core forming tools on a stationary support rod by a linkage responsive to a force to concurrently shift the core forming tools horizontally and radially relative to the well into engagement with the well side wall;

(2) incorporating resistance means in the support rod to limit the force applied to the linkage;

(3) applying a downward force to the linkage and concurrently compressing a biasing means, thereby forcing each said core forming tool to radially penetrate the well side walls and cut out a cylindrical core; and (4) continuing to increase the force until said resistant means is fully activated, thereby radially removing said core forming tools from engagement with the well side wall by the force exerted by said biasing means.

18. The method of claim 17 further comprising the step of fluid dampening the decompression of said biasing means, thereby cushioning the removing movements of said core forming tools.

19. The method of claim 17 wherein an increasing downward force on said linkage is produced by operation of a downhole pressure setting tool.

* * * * *